US005881968A

United States Patent [19]

Hsu

[11] Patent Number: 5,881,968

[45] Date of Patent: Mar. 16, 1999

[54] ADJUSTABLE TAPE-POSITIONING APPARATUS FOR A CHIP CARRIER MAKER

[75] Inventor: Hua-Shan Hsu, Taipei, Taiwan

[73] Assignee: Smooth Ocean Enterprise Co., Ltd., Taipei, Taiwan

[21] Appl. No.: 903,041

[22] Filed: Jul. 29, 1997

[51] Int. Cl.[6] ..... B65H 57/04; B65H 23/04

[52] U.S. Cl. ..... 242/615.3; 226/196.1

[58] Field of Search ..... 242/615, 615.1, 242/615.3; 226/196.1

[56] References Cited

U.S. PATENT DOCUMENTS

| | | | |
|---|---|---|---|
| 2,245,818 | 6/1941 | Pfeiffer | 242/615.3 X |
| 2,592,469 | 4/1952 | Rockhoff | 242/615.3 X |
| 3,692,223 | 9/1972 | Laigle et al. | 242/615.3 |
| 3,823,860 | 7/1974 | Perry | 242/615.3 |
| 3,896,983 | 7/1975 | Weinguni | 242/615.3 |

*Primary Examiner*—Michael Mansen

*Attorney, Agent, or Firm*—Finnegan, Henderson, Farabow, Garrett & Dunner

[57] ABSTRACT

An adjustable tape-positioning apparatus is adapted to position a tape on a chip carrier maker. The tape is moved along a straight path on the chip carrier maker and has a straight first side and a straight second side which are opposite and parallel to each other. The apparatus includes a stationary frame, and a movable abutment member mounted movably on the frame and having a vertical surface formed with a straight positioning slot which is adapted to receive slidably the first side of the tape therein and which is defined by a straight, vertical bottom wall. The bottom wall is adapted to be disposed parallel to the second side of the tape and is adapted to abut against the first side of the tape. A guide unit is disposed on the frame for guiding the abutment member to move on the frame in an adjusting direction that is transverse to the tape. An adjustment bolt is journalled operatively on the frame so as to rotate on the frame, thereby moving the abutment member on the frame in the adjusting direction.

3 Claims, 5 Drawing Sheets

ADJUSTABLE TAPE-POSITIONING APPARATUS FOR A CHIP CARRIER MAKER

BACKGROUND OF THE INVENTION

1. Field of the Invention

This invention relates to a chip carrier maker for manufacturing a row of interconnected chip carriers, more particularly to an adjustable tape-positioning apparatus for a chip carrier maker.

2. Description of the Related Art

In this art, a chip carrier maker is designed to make a row of interconnected chip carriers shown in FIGS. 1A and 1B, which are integrally formed with each other to form a tape 1 that is made of a thermoplastic material. Each of the chip carriers has a square recess 11 for accommodating a chip (not shown) therein, and several holes 12.

Referring to FIG. 2, in the conventional chip carrier maker 2, a tape 21 is fed from a tape supply unit 22 along a straight path on the maker 2 and is then machined in several machining units which include a heating unit 23 for heating the tape 21, a press unit 24 for pressing the tape 21 to form recesses therein, and a punching unit 25 for punching the tape 21 to form holes therethrough. Subsequently, the tape 21 is moved by a gripping unit 26 to a winding unit 27 in which the tape 21 is wound.

As shown in FIGS. 1A and 1B, the tape 1 has a straight first side 1A and a straight second side 1B which are opposite and parallel to each other.

To make chip carriers of different widths, a conventional adjustable tape-positioning apparatus shown in FIG. 3 is provided on the maker 2. Referring to FIG. 3, the conventional adjustable tape-positioning includes a stationary frame 31 and a generally T-shaped abutment member 32. The frame 31 has a vertical plate 310, a horizontal plate 312 with a slide slot 313 that is formed therethrough and that extends in a direction transverse to the tape, and two parallel vertical side plates 314 formed with aligned notches 315 through which the tape extends. The abutment member 32 includes an L-shaped sliding element 320, an adjustment bolt 321 extending through the sliding element 320 and the slot 313 to engage a nut 322, and a horizontal abutment plate 323 which is connected fixedly to an upper end of the sliding element 320 and which has a straight positioning slot 324 formed in a vertical side surface thereof. The abutment plate 323 extends into the notches 315 of the frame 31 so as to confine the first side 1A of the tape 1 (see FIG. 1A and 1B) within the slot 324, thereby preventing vertical movement of the first side 1A of the tape. Although the abutment member 32 can be moved on the frame 31 in a direction transverse to the tape, the sliding element 320 and the abutment plate 323 can rotate about the adjustment bolt 321 and cannot position accurately the tape at a desired location. In other words, after the abutment member 32 is adjusted, the abutment plate 323 may deflect from the straight path along which the tape is moved on the maker 2 (see FIG. 2). Under this case, the tape cannot move smoothly on the maker 2 (see FIG. 2) due to the fact that the sides 1A, 1B of the tape deflect from each other. As a result, when the tape is machined on the maker 2 (see FIG. 2), the recesses 11 and the holes 12 cannot be formed in predetermined positions in the tape.

SUMMARY OF THE INVENTION

An object of this invention is to provide a chip carrier maker with an adjustable tape-positioning apparatus which can position accurately tapes of different widths on the maker.

According to this invention, an adjustable tape-positioning apparatus is adapted to position a tape on a chip carrier maker. The tape is moved along a straight path on the chip carrier maker and has a straight first side and a straight second side which are opposite and parallel to each other. The apparatus includes a stationary frame, and a movable abutment member mounted movably on the frame and having a vertical surface formed with a straight positioning slot which is adapted to receive slidably the first side of the tape therein and which is defined by a straight, vertical bottom wall. The bottom wall is adapted to be disposed parallel to the second side of the tape and is adapted to abut against the first side of the tape. A guide unit is disposed on the frame for guiding the abutment member to move on the frame in an adjusting direction that is transverse to the tape. An adjustment bolt is journalled operatively on the frame so as to rotate on the frame, thereby moving the abutment member on the frame in the adjusting direction. Accordingly, when adjusted, the abutment member can move on the maker in such a manner that the bottom wall defining the slot can be maintained in a direction parallel to the tape, thereby positioning the tape accurately on the maker.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1B:
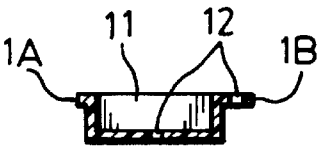
FIG.1B PRIOR ART
FIG. 1B is a cross sectional view of the tape shown in FIG. 1A.
Figure 1A:
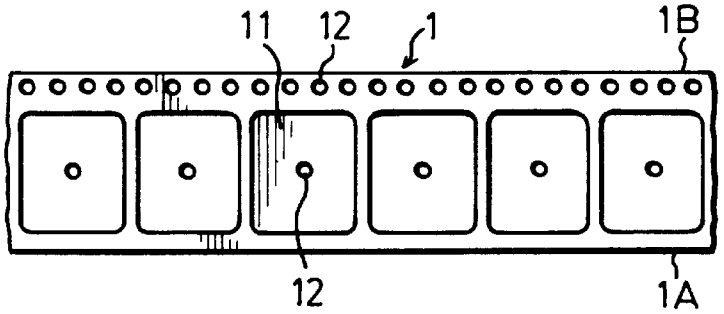
FIG.1A PRIOR ART
FIG. 1A shows a tape consisting of a row of interconnected chip carriers.
Figure 2:
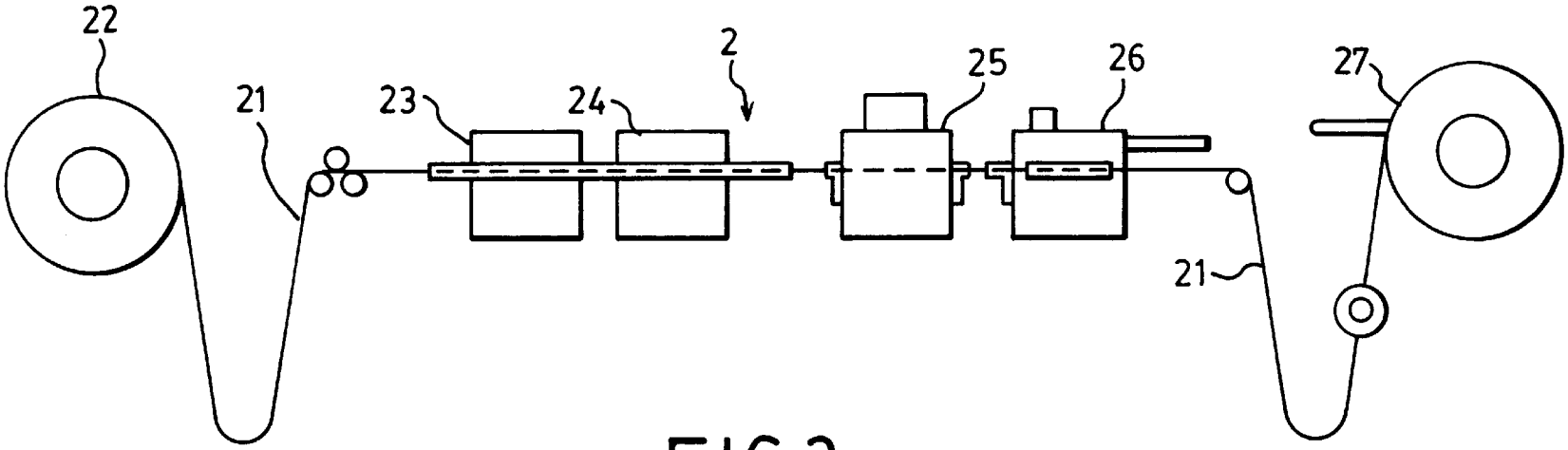
FIG.2 PRIOR ART
FIG. 2 illustrates how a tape is processed in a conventional chip carrier maker.
Figure 3:
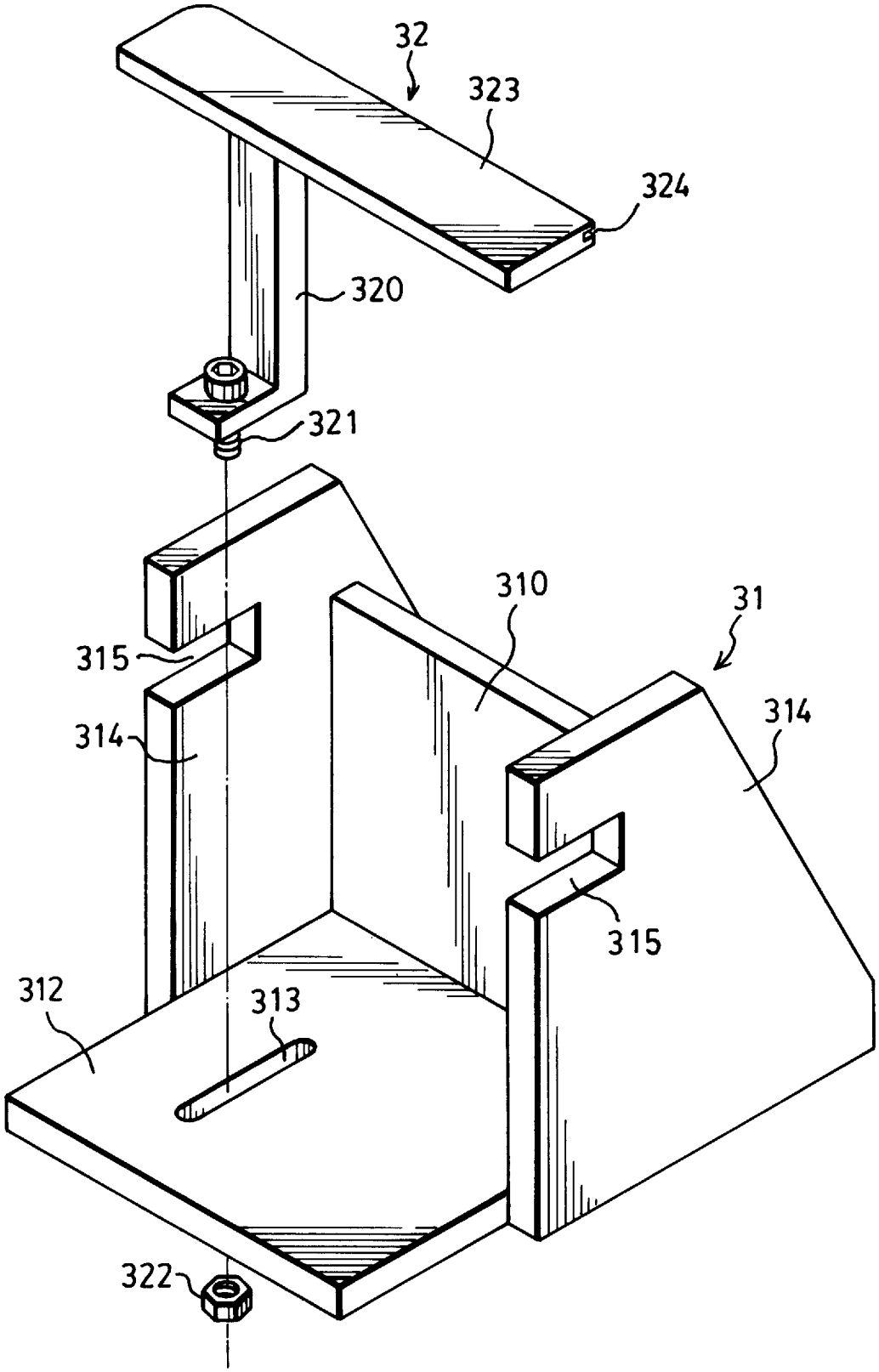
FIG.3 PRIOR ART
FIG. 3 is an exploded view of a conventional adjustable tape-positioning apparatus.
Figure 4:
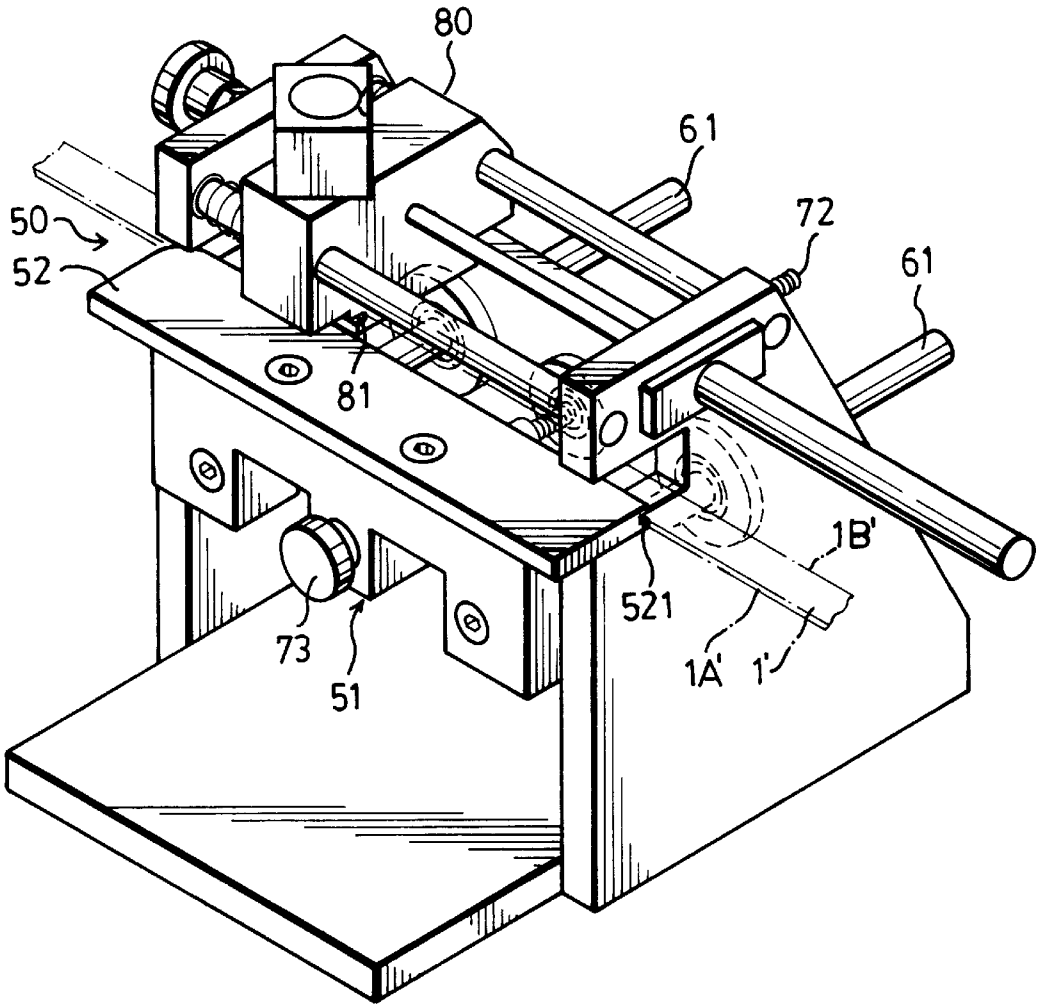
FIG. 4 is a perspective view of a preferred embodiment of an adjustable tape-positioning apparatus according to this invention.
Figure 5:
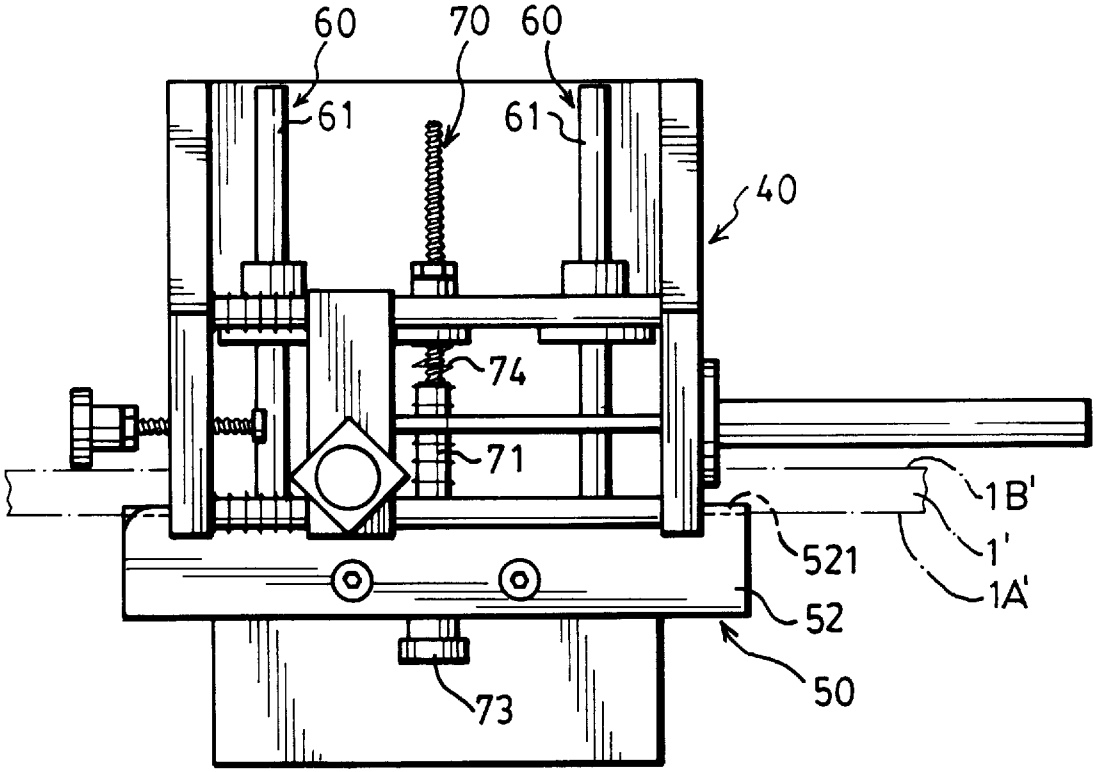
FIG. 5 is an elevational top view of the preferred embodiment of the adjustable tape-positioning apparatus according to this invention.
Figure 6:
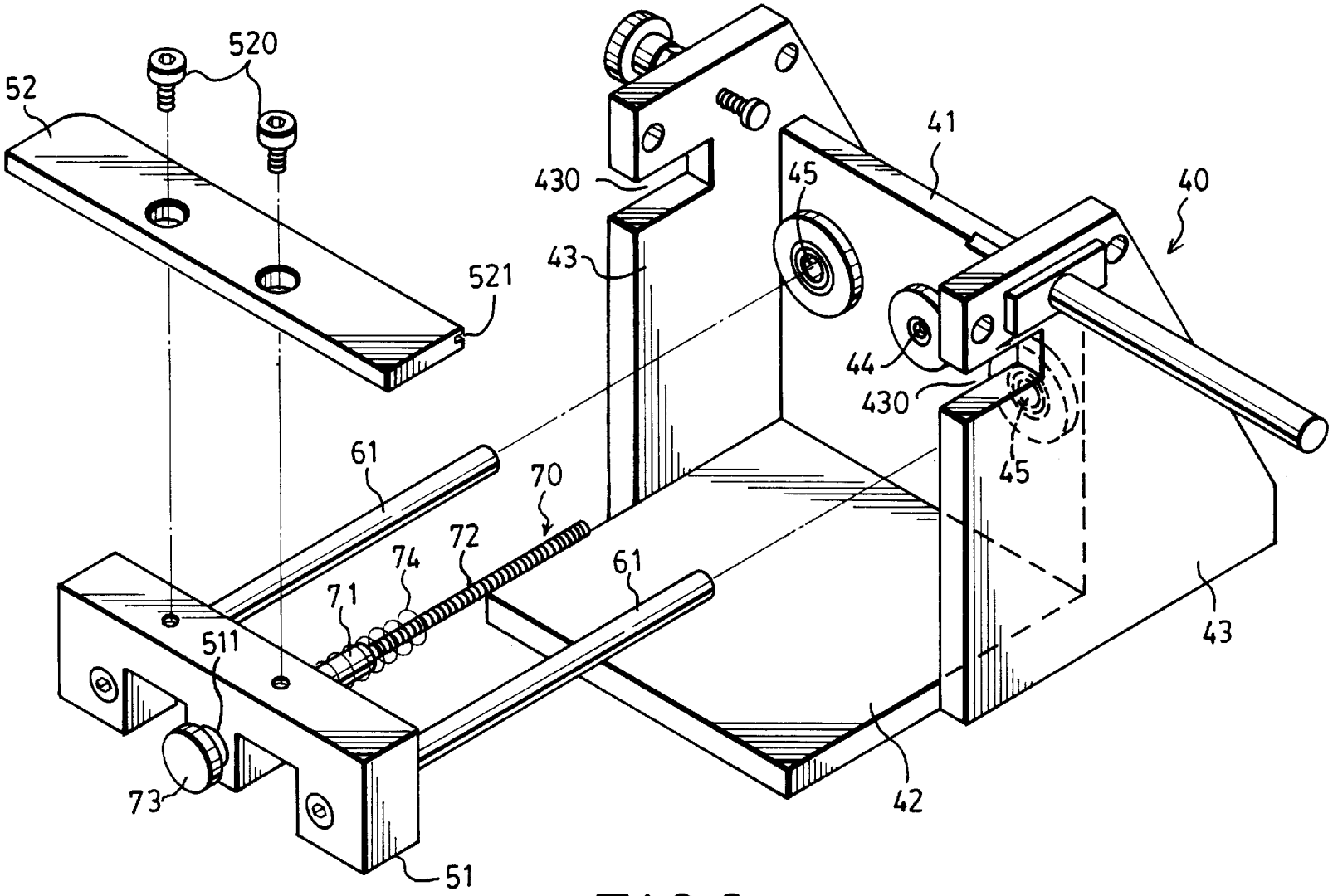
FIG. 6 is an exploded view of the preferred embodiment of the adjustable tape-positioning apparatus according to this invention.

Referring to FIGS. 4, 5 and 6, a preferred embodiment of an adjustable tape-positioning apparatus for a chip carrier maker according to this invention includes a stationary frame 40, a movable abutment member 50 mounted movably on the frame 40, a guide unit 60 disposed on the frame 40 for guiding the abutment member 50 to move on the frame 40 in an adjusting direction that is transverse to a tape 1' to be processed, and an adjustment bolt 70 journalled operatively on the frame 40 so as to rotate on the frame 40, thereby moving the abutment member 50 on the frame 40 in the adjusting direction. The tape 1' is moved along a straight path on the maker, and has a straight first side 1A' and a straight second side 1B' which are opposite and parallel to each other.

The frame 40 has a stationary vertical plate 41, a stationary horizontal plate 42 and two aligned stationary vertical plates 43. The vertical plates 43 are formed with two aligned notches 430 through which the tape 1' extends.

The abutment member 50 consists of an E-shaped sliding block 51 which is placed slidably over the horizontal plate 42 of the frame 40 and which is coupled with the guide unit 60 and the adjustment bolt 70, and a horizontal abutment plate 52 which is bolted to a top end of the sliding block 51 by bolts 520 and which has a vertical surface formed with an open-ended straight positioning slot 521 that is aligned with a straight positioning slot 81 in a machine frame 80. The second side 1B' of the tape 1' is confined within the slot 81 of the machine frame 80. The positioning slot 521 of the abutment plate 52 receives slidably the first side 1A' of the tape 1' therein and is defined by a straight, vertical bottom wall which is adapted to be disposed parallel to a bottom wall defining the slot 521 and to the second side 1B' of the tape 1' and which is adapted to abut against the first side 1A' of the tape 1'.

The adjustment bolt 70 has a non-threaded section 71 extending rotatably through a middle hole 511 in the sliding block 51, a threaded section 72 which is connected fixedly and coaxially to an end of the non-threaded section 71 and which extends threadably through a threaded hole 44 in the frame 40, and a rotary knob 73 which is connected fixedly and coaxially to the other end of the non-threaded section 71 and which has a diameter that is larger than that of the middle hole 511 of the sliding block 51 in order to retain the bolt 70 on the sliding block 51. A coiled compression spring 74 is sleeved on the bolt 70 between the vertical plate 41 and the sliding block 51 in order to press the sliding block 51 against the rotary knob 73. Rotation of the rotary knob 73 relative to the vertical plate 41 can move the sliding block 51 on the frame 40.

The guide unit 60 includes two guide holes 45 which are formed through the vertical plate 41 and which are located on two sides of the threaded hole 44, and two parallel, horizontal guide rods 61 which are connected fixedly to the sliding block 51 and which extend respectively and slidably through the guide holes 45 of the vertical plate 41.

It can be appreciated that, when adjusted, the abutment member 50 can be moved on the maker in such a manner that the bottom wall defining the slot 521 can be maintained in a direction parallel to the tape 1', thereby positioning the tape 1' accurately on the maker.

The abutment plate 52 can be replaced with a new one by removing the bolts 520 from the sliding block 51 so that the apparatus of this invention can be used to position a tape having a different thickness on the maker.

With this invention thus explained, it is apparent that numerous modifications and variations can be made without departing from the scope and spirit of this invention. It is therefore intended that this invention be limited only as indicated in the appended claims.

I claim:

1. An adjustable tape-positioning apparatus adapted to position a tape on a chip carrier maker, the tape being moved along a straight path on the chip carrier maker and having a straight first side and a straight second side which are opposite and parallel to each other, said apparatus comprising:

a stationary frame;

a movable abutment member mounted movably on said frame and having a vertical surface formed with a straight positioning slot which is adapted to receive slidably the first side of the tape therein and which is defined by a straight, vertical bottom wall that is adapted to be disposed parallel to the second side of the tape and that is adapted to abut against the first side of the tape;

a guide unit disposed on said frame for guiding said abutment member to move on said frame in an adjusting direction that is transverse to the tape; and an adjustment bolt journalled operatively on said frame so as to rotate on said frame, thereby moving said abutment member on said frame in said adjusting direction, wherein said frame has a stationary vertical plate which has a threaded hole formed therethrough, said abutment member having a middle hole formed therethrough, said adjustment bolt having a non-threaded section extending rotatably through said middle hole of said abutment member, a threaded section which is connected fixedly and coaxially to an end of said non-threaded section and which extends threadably through said threaded hole of said frame, and a rotary knob which is connected fixedly and coaxially to the other end of said non-threaded section and which has a diameter that is larger than that of said middle hole in order to retain said bolt on said abutment member, said apparatus further including a coiled compression spring sleeved on said bolt between said vertical plate and said abutment member in order to press said abutment member against said rotary knob, whereby, rotation of said rotary knob relative to said vertical plate can move said abutment member on said frame.

2. An apparatus as claimed in claim 1, wherein said guide unit includes two guide holes which are formed through said vertical plate and which are located on two sides of said threaded hole, and two parallel, horizontal guide rods which are connected fixedly to said abutment member and which extend respectively and slidably through said guide holes of said vertical plate.

3. An apparatus as claimed in claim 2, wherein said frame has a stationary horizontal plate, said abutment member including a sliding block which is placed slidably over said horizontal plate and which is coupled with said adjustment bolt and said guide rods, and a horizontal abutment plate which is bolted to a top end of said sliding block and which has said vertical surface formed with said slot.

* * * * *